US006772450B1

(12) United States Patent
Saylor et al.

(10) Patent No.: US 6,772,450 B1
(45) Date of Patent: Aug. 10, 2004

(54) TOILET BOWL CLEANING APPARATUS

(76) Inventors: Tom Saylor, 325 Alamo Square Dr., Alamo, CA (US) 94507; Victor Carrasquillo, 3424 Baywood Cir., Antioch, CA (US) 94531; Tim Lautze, 163 Avocado Pl., Brentwood, CA (US) 94513; Ernie Campora, 1174 Moccasin Ct., Clayton, CA (US) 94517

( * ) Notice: Subject to any disclaimer, the term of this patent is extended or adjusted under 35 U.S.C. 154(b) by 0 days.

(21) Appl. No.: 10/682,327

(22) Filed: Oct. 9, 2003

(51) Int. Cl.[7] ..... E03D 9/02
(52) U.S. Cl. ..... 4/223; 4/222
(58) Field of Search ..... 4/222, 223, 224, 4/300.2, 309, 313, 662, 664

(56) References Cited

U.S. PATENT DOCUMENTS

| | | | | |
|---|---|---|---|---|
| 1,818,562 | A | 8/1931 | Levy et al. | |
| 4,183,105 | A | 1/1980 | Womack | |
| 4,521,925 | A | 6/1985 | Chen et al. | |
| 4,745,639 | A | 5/1988 | Wileman, III | |
| 4,873,729 | A | 10/1989 | Micallef | |
| 5,022,098 | A | 6/1991 | Brower | |
| 5,455,971 | A | 10/1995 | Sakakibara et al. | |
| D380,816 | S | 7/1997 | Westmoreland | |
| 6,000,067 | A | 12/1999 | Cascia | |
| 6,467,101 | B1 | 10/2002 | Artola | |
| 6,622,315 | B1 * | 9/2003 | Feygin et al. | 4/223 |

FOREIGN PATENT DOCUMENTS

| | | |
|---|---|---|
| JP | 06329760 | 11/1994 |

* cited by examiner

*Primary Examiner*—Tuan N. Nguyen
(74) *Attorney, Agent, or Firm*—Thomas R. Lampe

(57) ABSTRACT

Apparatus for cleaning a toilet bowl includes a flexible, deformable conduit having a position memory. Spacers project from the conduit and bear against an inner wall of the toilet bowl to maintain pressurized water exit apertures in the conduit spaced from the inner wall and oriented toward flush water exit holes in the toilet bowl.

16 Claims, 2 Drawing Sheets

TOILET BOWL CLEANING APPARATUS

TECHNICAL FIELD

This invention relates to apparatus for cleaning a toilet bowl. The apparatus may also be utilized to direct chlorine or other sanitizing or cleaner chemicals into the bowl interior.

BACKGROUND OF THE INVENTION

The conventional approach for cleaning toilet bowls is to do so manually, with brushes being utilized to remove stains and undesired substances adhering to the bowl interior. Typically, the individual cleaning the bowl manually also uses a cleaning agent of some type to more effectively accomplish the task.

It is known generally to utilize mechanisms of various types in combination with toilet bowls to clean them. Some of these mechanisms spray water or water solutions into the interior of the bowl.

The following patents are believed to be representative of the current state of the art in this field: U.S. Pat. No. 4,745,639, issued May 24, 1988, U.S. Pat. No. 6,000,067, issued Dec. 14, 1999, U.S. Pat. No. 6,467,101, issued Oct. 22, 2002, U.S. Pat. No. 5,022,098, issued Jun. 11, 1991, U.S. Pat. No. 1,818,562, issued Aug. 11, 1931, U.S. Pat. No. 4,183,105, issued Jan. 15, 1980, U.S. Pat. No. 4,873,729, issued Oct. 17, 1989, U.S. Pat. No. 4,521,925, issued Jun. 11, 1985, U.S. Pat. No. 5,455,971, issued Oct. 10, 1995, U.S. Des. Pat. No. D380,816, issued Jul. 8, 1997 and Japanese Patent No. 08144345 A, Published Jun. 4, 1996.

The above–identified prior art does not teach or suggest the combination of structural elements disclosed and claimed herein.

DISCLOSURE OF INVENTION

The apparatus of the present invention is characterized by its relative simplicity and ease of operation. In addition, the apparatus can readily be retrofitted for use with toilet bowls of different sizes and configurations. The apparatus can be readily installed on a toilet even by the unskilled. It also may readily be removed from the toilet. No modifications to the structure of the toilet per se are required.

The apparatus is particularly effective in that it directs water and any sanitizing or cleaning agents dissolved therein to the vicinity of the flush water exit holes formed in the toilet bowl at the upper portion thereof and below the rim. This area of a toilet bowl is where ugly and unsanitary stains and deposits are particularly likely to be formed and accumulate. After impacting the toilet bowl in the vicinity of the flush water exit holes the water flows downwardly along the interior surface of the toilet bowl wall about the periphery thereof, providing highly effective and efficient cleaning.

The apparatus of the present invention is for selective releasable connection to a toilet bowl having a toilet bowl side wall defining a toilet bowl interior and a toilet bowl rim attached to the toilet bowl side wall and projecting over the toilet bowl interior. The toilet bowl defines flush water exit holes for directing flush water into the toilet bowl interior under the toilet bowl rim.

The apparatus is for cleaning the toilet bowl at the location of the flush water exit holes and includes a conduit having a conduit interior. The conduit is for positioning in the toilet bowl interior under the toilet bowl rim and for extending substantially the full length of the perimeter of the toilet bowl side wall. The conduit defines a plurality of outwardly directed, spaced apertures communicating with the conduit interior.

Spacer structure is connected to the conduit for frictionally engaging the toilet bowl side wall and cooperable with the toilet bowl side wall when the conduit is positioned in the toilet bowl interior to maintain the conduit at a predetermined position relative to the toilet bowl side wall with the outwardly directed, spaced apertures thereof generally oriented toward the flush water exit holes.

A water supply pipe or line is connected to the conduit for delivering pressurized water to the conduit interior from a source of pressurized water whereby the pressurized water exits the outwardly directed, spaced apertures and is directed toward the toilet bowl in the vicinity of the flush water exit holes.

Other features, advantages and objects of the present invention will become apparent with reference to the following description and accompanying drawings.

BEST MODE FOR CARRYING OUT THE INVENTION

Figure 5:
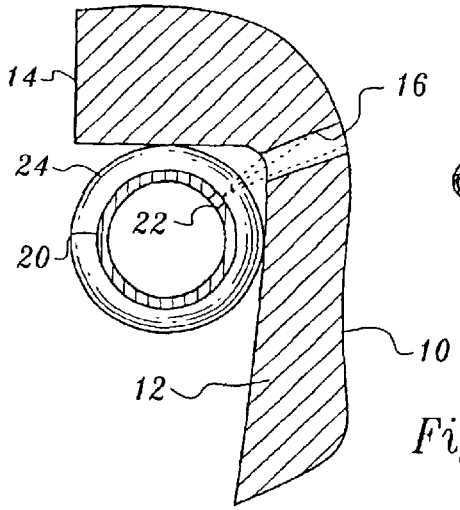
FIG. 5 is a greatly enlarged, cross-sectional view showing a section of the upper portion of the toilet bowl and illustrating a spacer ring associated with the conduit in position within the toilet bowl and in engagement with the toilet bowl rim and the toilet bowl side wall.
Figure 6:
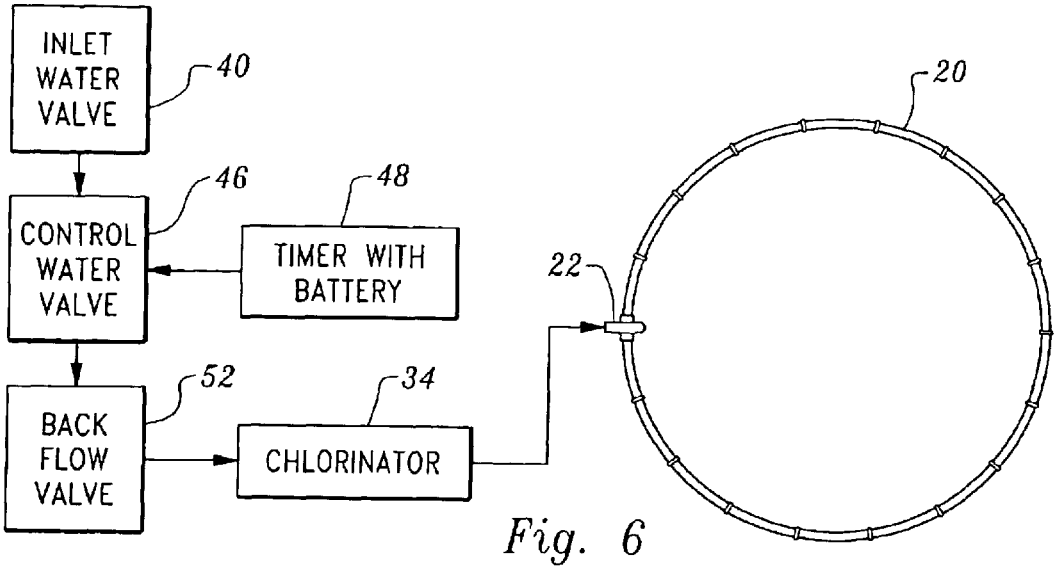
FIG. 6 is a diagrammatic presentation of structural elements of the apparatus.

Referring now to the drawings, apparatus constructed in accordance with the teachings of the present invention is utilized to clean a toilet bowl 10 of a standard toilet. The toilet bowl has a toilet bowl side wall 12 and a toilet bowl rim 14 projecting over the toilet bowl interior defined by the toilet bowl side wall. The toilet bowl defines flush water exit holes 16 spaced from one another and communicating with the interior of the toilet bowl for directing flush water into the toilet bowl in a conventional manner. In the present arrangement, the flush water exit holes are formed in the toilet bowl side wall closely adjacent to the rim. FIG. 5 shows one such flush water exit hole, it being understood that the others are generally of like configuration.

The toilet bowl side wall diverges in an upward direction and forms an interior corner with the toilet bowl rim extending about the upper portion of the toilet bowl interior. The above-described toilet bowl structure is of a typical, conventional nature, as stated above.

The apparatus of the present invention is for cleaning the toilet bowl 10 in the vicinity of the flush water entry holes and elsewhere. The apparatus includes a conduit 20 having a conduit interior. The conduit is positioned in the toilet bowl interior under the toilet bowl rim 14 and extends substantially the full length of the interior perimeter of the toilet bowl side wall. The conduit defines a plurality of outwardly directed, spaced apertures 22 communicating with the conduit interior.

Spacer structure is connected to the conduit which frictionally engages the toilet bowl side wall 12 and is cooperable therewith to maintain the conduit at a predetermined position relative to the toilet bowl side wall with the outwardly directed, spaced apertures 22 thereof oriented toward the flush water exit holes.

The spacer structure is in the form of a plurality of projections or rings 24 extending about the conduit. The rings may be formed of any suitable material such as plastic. They may be integral with the conduit or comprise separate parts connected thereto.

Figure 2:
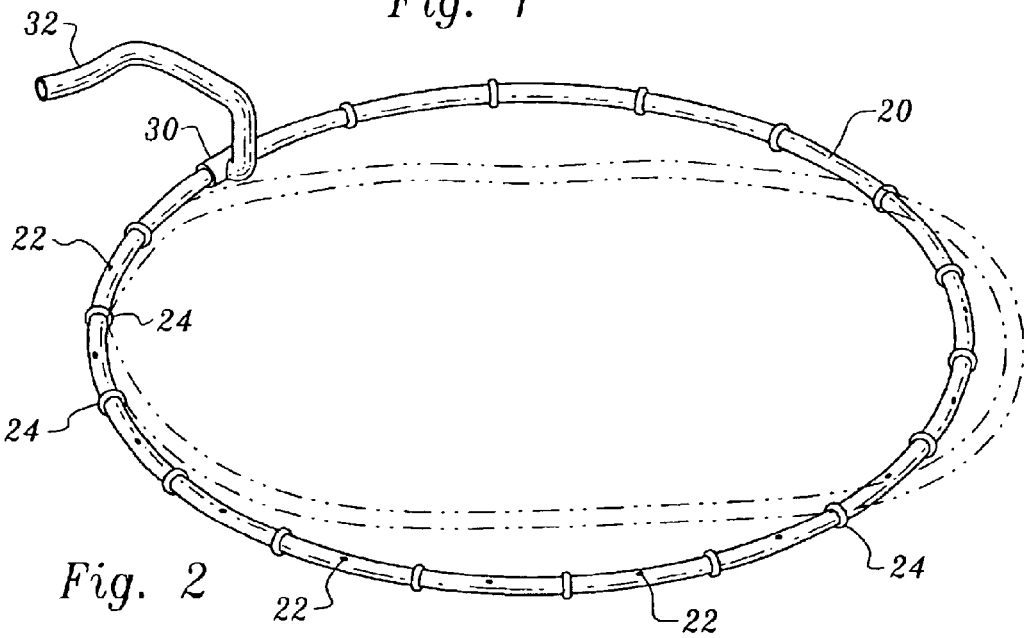
FIG. 2 is an enlarged, perspective view illustrating a component of the present invention to be inserted into the bowl of the toilet, solid lines being utilized to show the normal configuration of a conduit of the component and dash lines being utilized to show a different conduit configuration caused by the application of external forces on the component.

Conduit 20 is formed of flexible, resilient material such as plastic and has a selectively deformable, generally circular configuration. The conduit may be bent when a manual force is applied thereto to change it to an alternate configuration such is that indicated by the dash lines in FIG. 2 so that the conduit can be removed from the toilet bowl or positioned therein. The conduit has an elastic or position memory so that it generally conforms to the shape of the toilet bowl side wall after being positioned therein. The rings 24 engage the toilet bowl side wall and maintain a space between the conduit and the toilet bowl side wall.

In the arrangement illustrated, the outwardly diverging toilet bowl wall exerts a cam like action on the rings 24 urging the rings and conduit in an upward direction. In the arrangement illustrated, the rings also abut against the bottom of the toilet bowl rim and are lodged along with the conduit in the interior corner defined by the toilet bowl rim and the toilet bowl side wall. In such position the apertures 24 are disposed adjacent to the flush water exit holes.

It will be appreciated that the deformable conduit construction enables the conduit to conform to the shapes of different shaped toilet bowls. The length of the conduit can be modified to adapt the apparatus to different sized toilet bowls as well, as will now be described.

Figure 3:
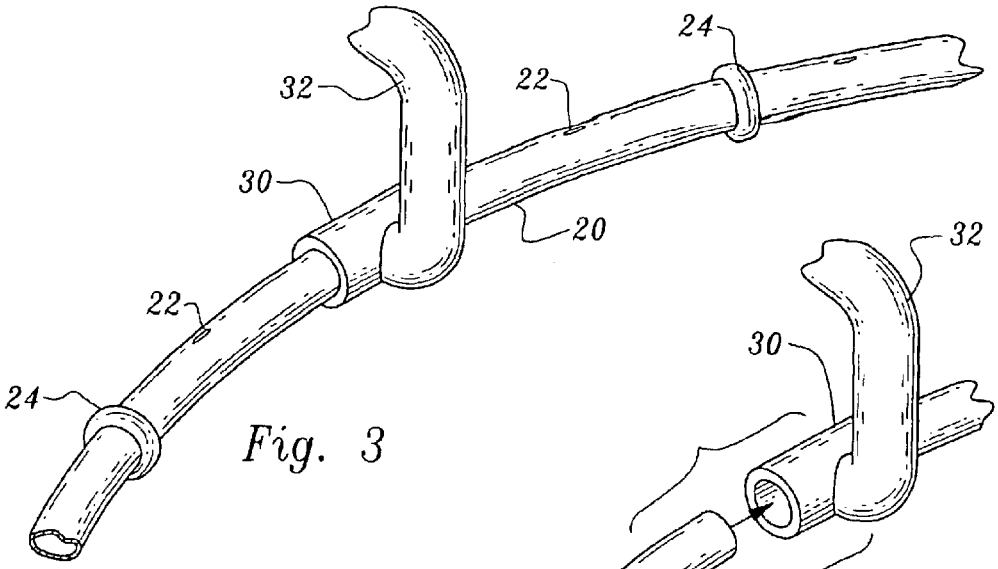
FIG. 3 is a greatly enlarged, perspective view illustrating a portion of the conduit and associated structure, including spacer rings disposed about the conduit and a portion of a water supply pipe or line operatively associated with the conduit.
Figure 4:
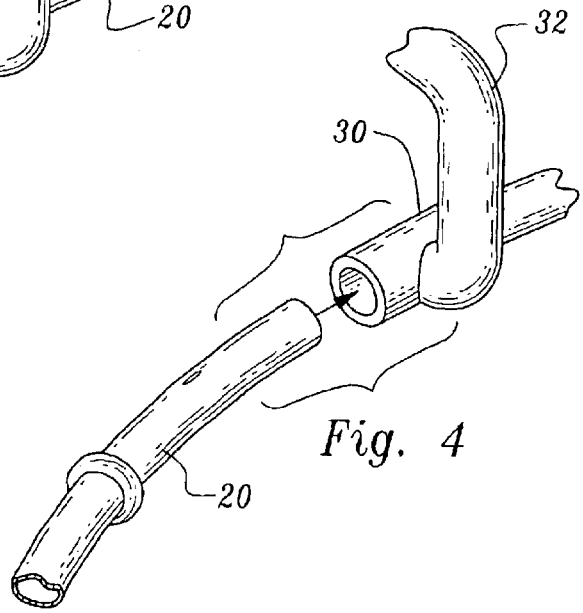
FIG. 4 is a greatly enlarged perspective view showing an end of the conduit in the process of being inserted into a fitting employed to connect the conduit to the water supply pipe.

The conduit 20 has two ends which are positioned in a fitting 30. FIG. 3 shows both ends frictionally seated within the T-type fitting 30 and FIG. 4 shows one of the ends just prior to insertion into the fitting. It will be appreciated that the conduit can be shortened to adapt it to a smaller sized toilet bowl by cutting off an end length thereof.

Fitting 30 has a water supply pipe or line 32 connected thereto and provides liquid flow communication between the conduit interior and the interior of the water supply pipe.

Line 32 is connected to a chemical injector 34 utilized to hold chlorine or some other chemical which will be introduced into the water flowing to conduit 20 to facilitate cleaning and/or disinfecting of the toilet bowl. The water is pressurized and exits apertures 22 in the vicinity of the flush water exit holes (see FIG. 5) and from that point the water flows down the interior surface of the toilet bowl side wall.

Figure 1:
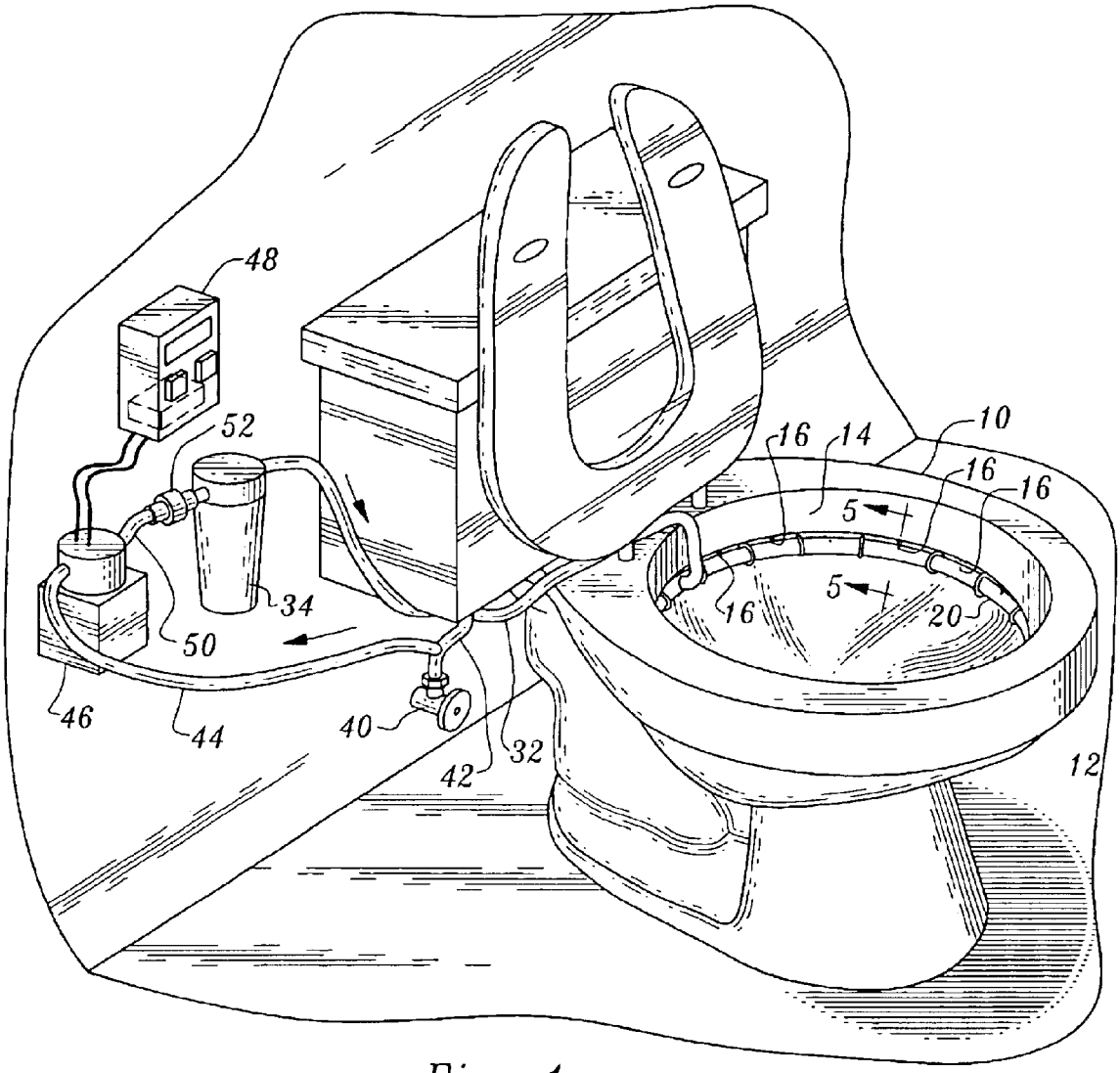
FIG. 1 is a perspective view illustrating a toilet with apparatus constructed in accordance with the teachings of the present invention installed in operative association therewith.

The water flowing through the cholorinator or chemical injector 34, water supply line 32 and conduit 20 comes from the same source of water utilized to supply the toilet with flush water. FIG. 1 shows a conventional manually actuatable inlet water valve 40 connected to a water pipe of the house or other structure within which the toilet is located. Tapped into the flush water line 42 is a line 44 leading to a control water valve 46. A timer 48 of any known construction is utilized to automatically turn the control water valve 46 on or off, it being understood that the timer can be programmed as desired.

From control water valve 46 the water flows through a line 50 to the chlorinator or chemical injector 34. A back flow prevention valve 52 is located between the control water valve and the injector 34.

The invention claimed is:

1. Apparatus for selective releasable connection to a toilet bowl having a toilet bowl side wall defining a toilet bowl interior and a toilet bowl rim attached to said toilet bowl side wall and projecting over said toilet bowl interior, said toilet bowl defining flush water exit holes for directing flush water into said toilet bowl interior under said toilet bowl rim, said apparatus for cleaning said toilet bowl at the location of said flush water exit holes and comprising, in combination:

a conduit having a conduit interior, said conduit for positioning in said toilet bowl interior under said toilet bowl rim and for extending substantially the full length of the perimeter of said toilet bowl side wall, said conduit defining a plurality of outwardly directed, spaced apertures communicating with said conduit interior;

spacer structure connected to said conduit for frictionally engaging said toilet bowl side wall and cooperable with said toilet bowl side wall when said conduit is positioned in said toilet bowl interior to maintain said conduit at a predetermined position relative–to said toilet bowl side wall with said outwardly directed, spaced apertures thereof generally oriented toward said flush water exit holes; and a water supply pipe connected to said conduit for delivering pressurized water to said conduit interior from a source of pressurized water whereby said pressurized water exits said outwardly directed, spaced apertures and is directed toward said toilet bowl in the vicinity of said flush water exit holes.

2. Apparatus according to claim 1 wherein said spacer structure comprises a plurality of projections projecting outwardly from said conduit.

3. Apparatus according to claim 2 wherein said projections comprise spaced rings extending about said conduit.

4. Apparatus according to claim 1 wherein said conduit is resilient and has a selectively deformable, generally circular configuration, said conduit having a position memory and cooperable with said spacer structure and said toilet bowl side wall when positioned in said toilet bowl interior to resist downward movement of said conduit within said toilet bowl interior from said predetermined position.

5. Apparatus according to claim 1 additionally comprising at least one water control valve operatively associated with said water supply pipe for controlling the flow of water through said water supply pipe.

6. Apparatus according to claim 5 additionally comprising a timer operatively associated with said at least one water control valve to automatically open and close said at least one water control valve.

7. Apparatus according to claim 5 additionally comprising a chemical injector located between said at least one water control valve and said conduit for introducing chlorine or other desired chemical into water delivered to said conduit interior.

8. In combination:

a toilet bowl having a toilet bowl side wall defining a toilet bowl interior and a toilet bowl rim attached to said toilet bowl side wall and projecting over said toilet bowl interior, said toilet bowl defining flush water exit holes for directing flush water into said toilet bowl interior under said toilet bowl rim; and apparatus for cleaning said toilet bowl at the location of said flush water exit holes and comprising, in combination:

a conduit having a conduit interior positioned in said toilet bowl interior under said toilet bowl rim and extending substantially the full length of the perimeter of said toilet bowl side wall, said conduit defining a plurality of outwardly directed, spaced apertures communicating with said conduit interior;

spacer structure connected to said conduit frictionally engaging said toilet bowl side wall and cooperable with said toilet bowl side wall to maintain said conduit at a predetermined position relative to said toilet bowl side wall with said outwardly directed, spaced apertures thereof generally oriented toward said flush water exit holes; and a water supply pipe connected to said conduit for delivering pressurized water to said conduit interior from a source of pressurized water whereby said pressurized water exits said outwardly directed, spaced apertures and is directed toward said toilet bowl in the vicinity of said flush water exit holes.

9. The combination according to claim 8 wherein said spacer structure comprises a plurality of projections projecting outwardly from said conduit.

10. The combination according to claim 9 wherein said projections comprise spaced rings extending about said conduit.

11. The combination according to claim 8 wherein said conduit is resilient and has a selectively deformable, generally circular configuration, said conduit having a position memory and cooperable with said spacer structure and said toilet bowl side wall to resist downward movement of said conduit within said toilet bowl interior from said predetermined position.

12. The combination according to claim 8 wherein said apparatus additionally comprises at least one water control valve operatively associated with said water supply pipe for controlling the flow of water through said water supply pipe.

13. The combination according to claim 12 wherein said apparatus additionally comprise a timer operatively associated with said at least one water control valve to automatically open and close said at least one water control valve.

14. The combination according to claim 12 wherein said apparatus additionally comprises a chemical injector located between said at least one water control valve and said conduit for introducing chlorine or other desired chemical into water delivered to said conduit interior.

15. The combination according to claim 8 wherein said toilet bowl side wall diverges in an upward direction and forms an interior corner with said toilet bowl rim extending about an upper portion of the toilet bowl interior, said predetermined position being under the toilet bowl rim at said corner.

16. The combination according to claim 15 wherein said spacer structure is in frictional engagement with said toilet bowl rim and with said toilet bowl side wall and bears against and is cooperable with said diverging toilet bowl side wall to resist downward movement of said conduit and spacer structure.

* * * * *